US005217784A

United States Patent [19]

Shepherd

[11] Patent Number: 5,217,784

[45] Date of Patent: Jun. 8, 1993

[54] CORNICE BOARD

[76] Inventor: Dorothy C. Shepherd, 6108 Waterford Ct., Edina, Minn. 55436

[21] Appl. No.: 697,627

[22] Filed: May 9, 1991

[51] Int. Cl.[5] ..... E06B 9/00

[52] U.S. Cl. ..... 428/99; 428/119; 428/138; 160/38; D6/579

[58] Field of Search ..... 428/99, 119, 131, 138; 52/287; 160/39, 38, 19; D6/578, 579; D25/55, 60

[56] References Cited

U.S. PATENT DOCUMENTS 574,348 12/1896 DeKalb Turbeville ..... 160/19

2,602,500 7/1952 Slavin et al. ..... 160/38

*Primary Examiner*—Alexander S. Thomas

*Attorney, Agent, or Firm*—Palmatier, Sjoquist & Helget

[57] ABSTRACT

A cornice board constructed of a rigid material containing a plurality of openings located on a first side, front face, and second side. These openings may be selectively plugged, by various removable plugs. The rigid cornice board is adaptable to contain a decorative fabric interleaved through the selected plurality of openings in order to create the desired design effect.

5 Claims, 3 Drawing Sheets

CORNICE BOARD

The present invention relates to a cornice board providing versatility and convenience to designing the interior of rooms.

BACKGROUND OF THE INVENTION

Cornice structures have been used to hide valance or blind fixtures. The conventional cornice apparatus is frequently covered with a decorative fabric or material which does not provide flexibility for interior design, and makes changing the covering material difficult once a cornice device has been affixed to a wall. Disassembly and redesign of conventional cornice structures to achieve a new design effect is difficult, time consuming and costly.

Conventional cornice structures are comprised of basic curtain rods or wood frames covered entirely in a decorative fabric. These cornice structures often do not provide an ornamental look or style that improves the interior design of a room, and do not provide decorative flexibility in covering blind fixtures, nor do these devices provide aesthetic or functional utility in creating new interior design effects.

A decorator is unable to easily manipulate the surface designs of conventional cornice boards; the only design option is choice of a covering fabric.

The conventional cornice structure does not provide a convenient, efficient, and cost effective method of modification of a desired design fabric absent disassembly of the cornice unit from the wall. The prior art does not provide the decorator with flexibility in design of decorative cornice compositions.

SUMMARY OF THE INVENTION

The present invention is a cornice board structure constructed of a rigid material containing a plurality of openings located on a first side, front face, and second side. These openings may be selectively plugged, by various removable plugs. These plugs may be attached or affixed to the rigid cornice board in a variety of patterns. The rigid cornice board is adaptable to contain a decorative fabric interleaved through the selected plurality of openings in order to create the desired design effect.

A feature of the invention is the combination of the rigid cornice board, having a plurality of openings, with a decorative fabric material, where the decorative fabric material is artistically interleaved through the plurality of openings, as desired to obtain the appropriate design effect.

Another feature of the invention is a plurality of removable plugs, which may be inserted and/or removed from the rigid cornice board, to cover one or more of the plurality of openings, as desired for the appropriate design effect.

These and other objects and features will be evident upon a study of the following specification and accompanying drawings.

BRIEF DESCRIPTION OF THE DRAWINGS

FIG. 1 shows a decorative fabric interleaved through the plurality of openings, an example of one of the many possible desired design effects.

DETAILED DESCRIPTION OF THE PREFERRED EMBODIMENT

One form of the invention is illustrated and described herein. The cornice board is indicated in general by the numeral 10.

Figure 1:
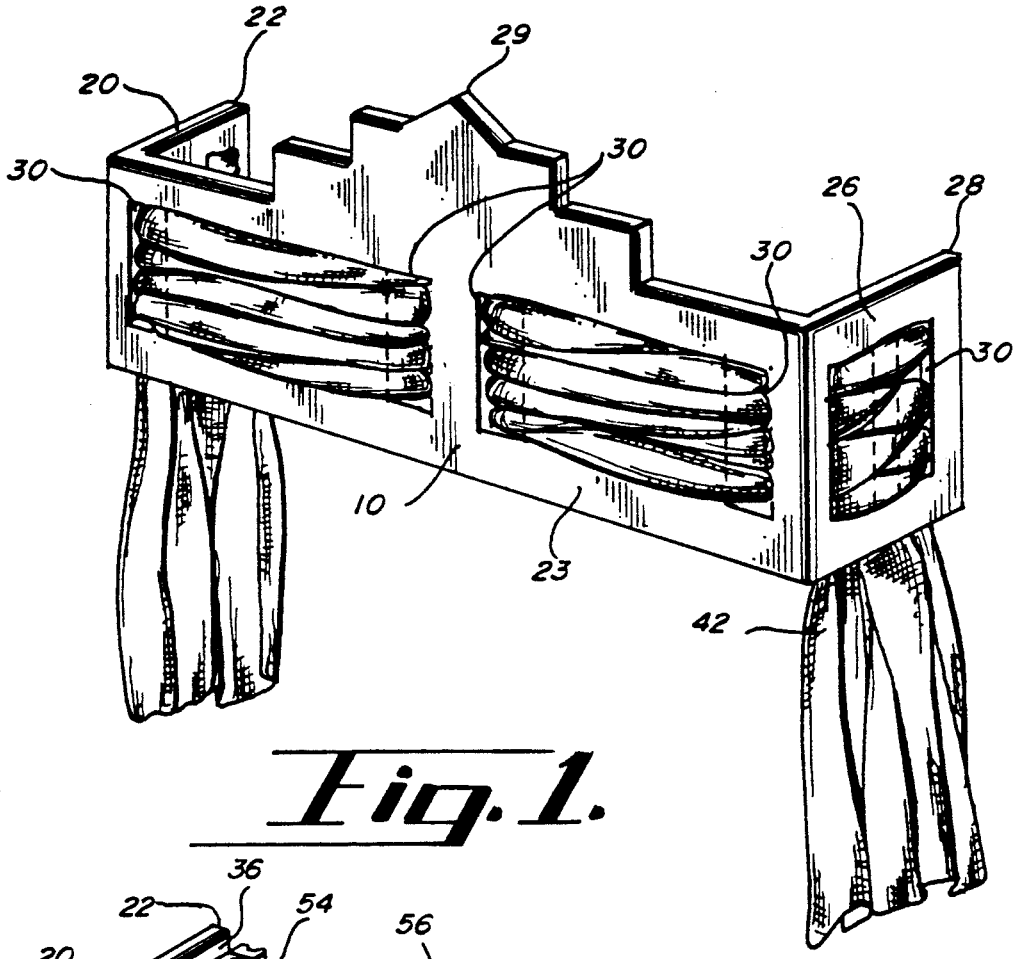
FIG. 1 is an isometric view of the cornice board invention.

As shown in FIG. 1, a desired design fabric 42 may be interleaved through any combination of the openings 30 in order to achieve the desired design effect. The design fabric 42 may be interleaved through, draped over, wrapped around, and/or knotted between, any combination of the openings 30. The designer is not limited in creating artistic compositions between the cornice board 10 and a single, or plurality of, decorative design fabrics 42. A preferred feature of the invention is the placement of openings 30 in relatively closely spaced pairs in cornice board 10, as is shown with respect to side panel 26 in FIG. 1. However, the openings 30 may also be widely spaced as is shown with respect to front panel 23 of cornice board 10. It has been found useful to utilize openings in pairs, to achieve the best design effects.

Cornice board 10 may be affixed to a wall surface by attaching a mounting bracket along the inner edge 22, 28 of side panels 20, 26. The front panel 23 of the cornice board may incorporate other decorative designs, such as at 29, to achieve various design effects.

Figure 2A:
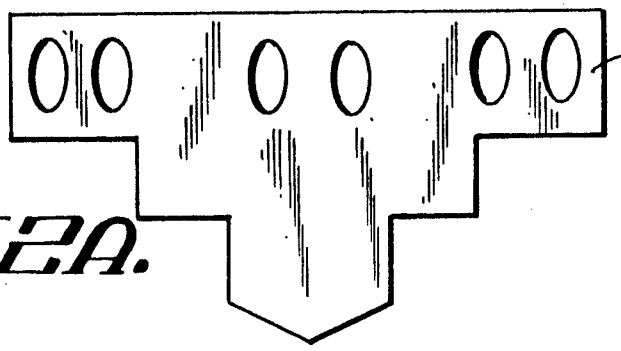
FIGS. 2A–2F are front views of various alternate forms of the cornice board invention showing the plurality of openings in varying stylistic designs.
Figure 2B:
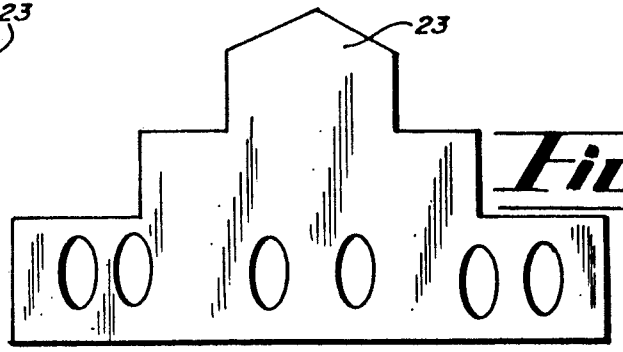
Figure 2C:
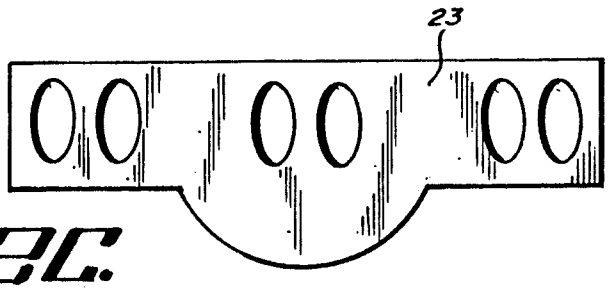
Figure 2D:
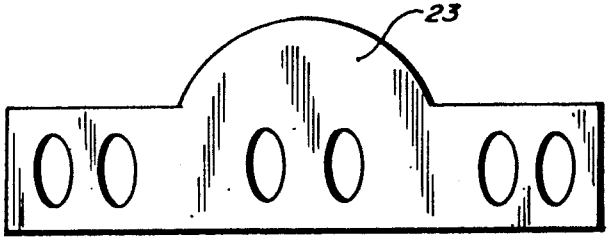
Figure 2E:
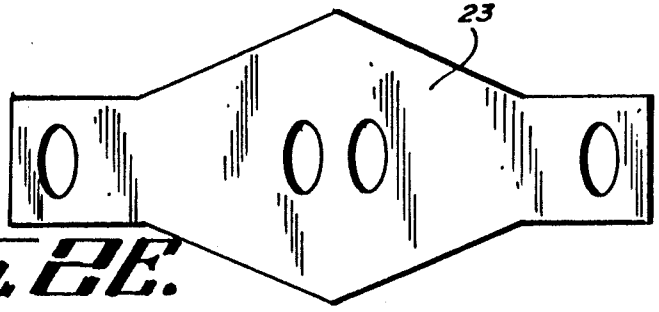
Figure 2F:
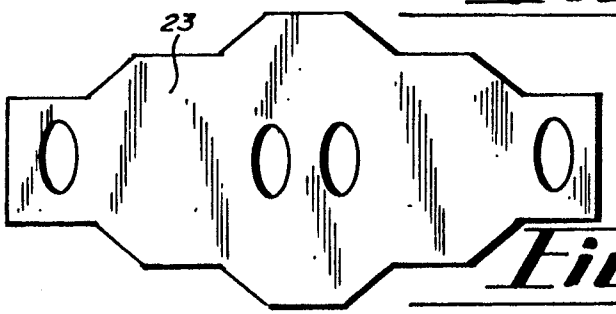

Referring to FIGS. 2A–2F, 3 and 4, various embodiments of the cornice board structure 10 may be seen. The cornice board structure 10 is suitably made of molded rigid plastic, fiberglass, wood, or other rigid material. The embodiment shown in FIGS. 2A–2F differ essentially in the different designs adopted for the shape of the front panel 23. These designs are intended to be merely representative of a wide choice of available designs and geometric shapes which might be selected to form front panel 23. It should be noted that the openings in front panel 23 are preferably placed in pairs, although FIG. 2E and FIG. 2F show an example wherein single openings may be placed at respective ends of front panel 23.

Figure 3:
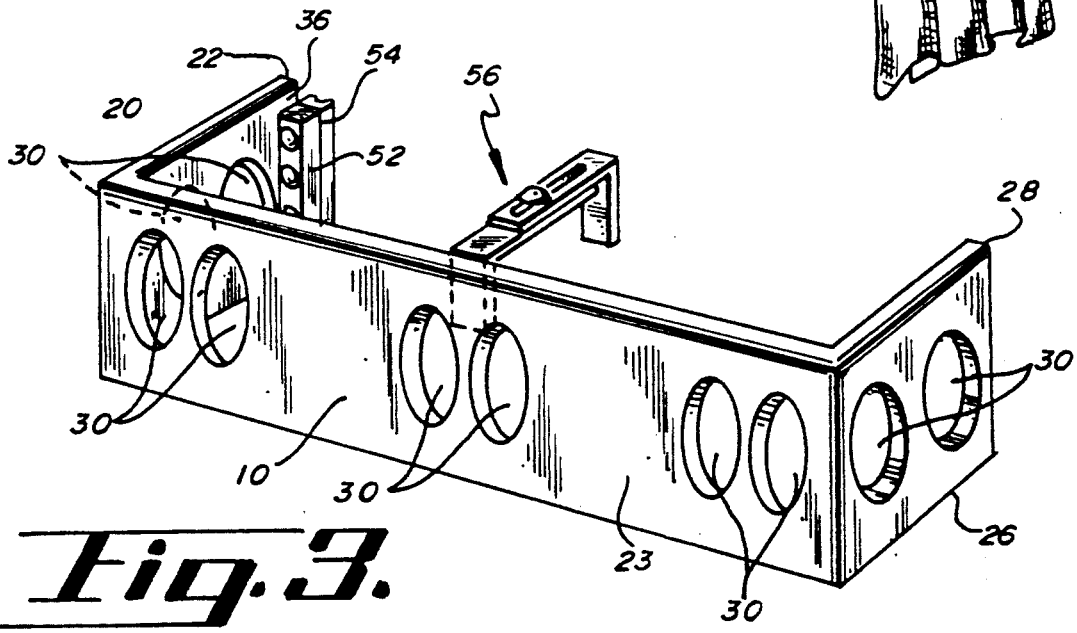
FIG. 3 is an isometric view of the cornice board invention showing a plurality of openings and one of the many means for attachment of the cornice board invention to a wall.

FIG. 3 shows an isometric view of a representative cornice board 10, having three pairs of openings 30 spaced across front panel 23 and a single pair of openings 30 spaced along each of the side panels 20 and 26. FIG. 3 also shows a representative mounting bracket arrangement, wherein a mounting rib 52 may be affixed to the inner surface 36 of an end panel near its inner ends 22. A wall bracket 54 may be affixed to the wall at a predetermined location, and mounting rib 52 may then be affixed to bracket 54 using fasteners of various types. FIG. 3 also shows a form of center bracket 56 which may be used to support the cornice board, particularly when it is constructed of significant length.

Figure 4:
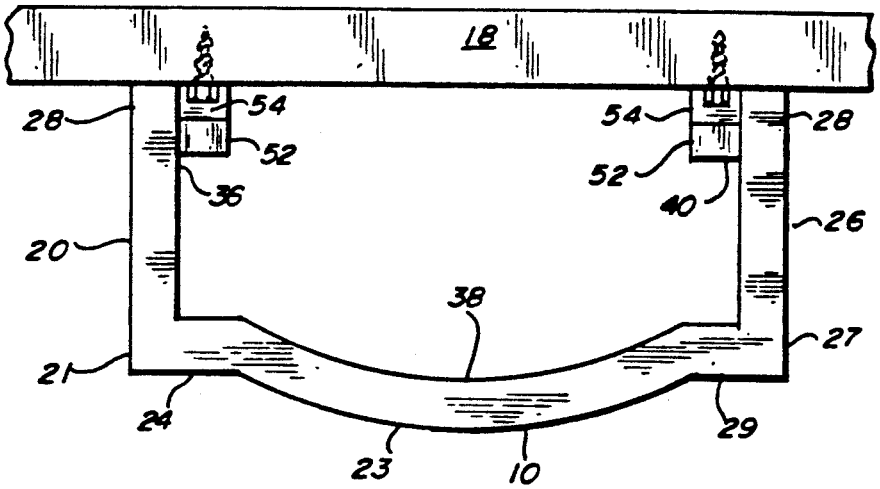
FIG. 4 is a top view of the cornice board invention showing one of the many varying stylistic designs for the cornice board invention.

FIG. 4 shows a top view of another embodiment of cornice board 10, having an outwardly curved front panel 23, with a convex interior surface 38. The mounting ribs 52 may be a molded extension of the respective side panels, as shown in FIG. 4, and these ribs may be affixed to wall mounting brackets 54 by fasteners as shown in FIG. 4. FIG. 4 shows a wall section 18 in cross-sectional view.

Figure 5:
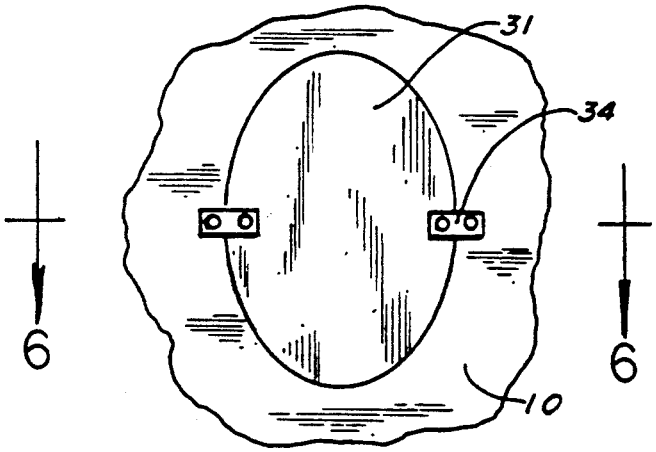
FIG. 5 is a rear view of a plug for insertion into one or more of the plurality of openings of the cornice board invention. This figure also shows the means for securing the plug to the cornice board device.
Figure 6:
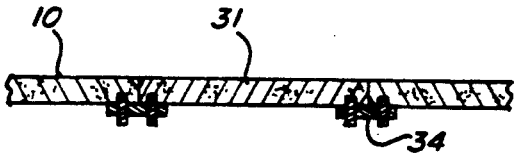
FIG. 6 is a cross-section view taken along line 6—6 of FIG. 5 showing a plug for insertion into one or more of the plurality of openings of the cornice board invention. This figure also shows a means for securing the plug to the cornice board invention.

FIG. 5 shows a rear view of a portion of cornice board 10, and FIG. 6 shows a cross-sectional view taken along the lines 6—6 of FIG. 5. A plug 31 may be inserted into the opening 30, and may be attached to the cornice board by means of one or more fastener brackets 34. The fastener brackets 34 are preferably attached along a rear surface of the cornice board in order to conceal the fastening mechanism.

In operation, the cornice board is affixed to a wall surface according to any well known technique. Selected openings in the cornice board may be either plugged or open, according to the design effect desired, and a drapery or other fabric is interwoven through the remaining openings to complete the overall design effect. Any time a design change is desired, it is merely necessary to remove and replace the fabric material according to a new pattern of interweaving through the openings in the cornice board, or to replace the existing fabric material according to a new arrangement through the openings of the cornice board. In an appropriate setting more than one fabric material may be utilized in connection with the cornice board.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. A cornice board device for attachment to a vertical wall surface comprising:

a) a first side panel with an outer end, and an inner end for attachment to the vertical wall surface;

b) a second side panel with an outer end, and an inner end for attachment to the vertical wall surface;

c) a front panel containing a first end and a second end, with the first end of the front panel affixed to the outer end of the first side panel, and the second end of the front panel affixed to the distal end of the second side panel;

d) a plurality of openings located on the first side panel front panel, and second side panel, and e) a fabric material interleaved through the plurality of openings.

2. The cornice board device according to claim 1, wherein the inner ends of the first and second side panels further comprise a means for affixing the cornice board device to the vertical wall surface.

3. The cornice board device of claim 2, wherein the cornice board further comprises means covering one or more of the plurality of openings.

4. The cornice board device of claim 3, wherein the means covering further comprises a plurality of plugs inserted into the plurality of openings.

5. The cornice board device of claim 4, wherein the first side panel, second side panel and front panel are constructed from a rigid material selected from the group consisting of wood, fiberglass, aluminum, plastic and steel.

* * * * *